US008857739B2

(12) United States Patent
Huang et al.

(10) Patent No.: US 8,857,739 B2
(45) Date of Patent: Oct. 14, 2014

(54) AIR-COOLED SWIRLERHEAD

(75) Inventors: Yimin Huang, Seabrook, NH (US); Shaun Sullivan, Northwood, NH (US); Brian Finstad, Eliot, ME (US); Alexander Haplau-Colan, Stratham, NH (US)

(73) Assignee: Flexenergy Energy Systems, Inc., Portsmouth, NH (US)

( * ) Notice: Subject to any disclaimer, the term of this patent is extended or adjusted under 35 U.S.C. 154(b) by 76 days.

(21) Appl. No.: 13/323,754

(22) Filed: Dec. 12, 2011

(65) Prior Publication Data

US 2012/0079827 A1 Apr. 5, 2012

Related U.S. Application Data

(62) Division of application No. 12/034,064, filed on Feb. 20, 2008, now Pat. No. 8,096,132.

(51) Int. Cl.

| | |
|---|---|
| ***B05B 7/10*** | (2006.01) |
| ***F02C 1/00*** | (2006.01) |
| ***F02G 3/00*** | (2006.01) |
| ***F23R 3/14*** | (2006.01) |
| ***F23R 3/28*** | (2006.01) |
| ***F23R 3/46*** | (2006.01) |

(52) U.S. Cl.

CPC . *F23R 3/14* (2013.01); *F23R 3/283* (2013.01); *F23R 3/286* (2013.01); *F23R 3/46* (2013.01)

USPC ..... 239/399; 60/737

(58) Field of Classification Search

USPC ..... 239/399, 405; 60/748, 737, 752

See application file for complete search history.

(56) References Cited

U.S. PATENT DOCUMENTS

| | | | | |
|---|---|---|---|---|
| 2,471,892 | A * | 5/1949 | Price | 60/268 |
| 2,583,416 | A * | 1/1952 | Clarke et al. | 60/738 |
| 3,570,242 | A * | 3/1971 | Leonardi et al. | 60/737 |
| 3,605,405 | A | 9/1971 | Du Bell | |

(Continued)

FOREIGN PATENT DOCUMENTS

| | | |
|---|---|---|
| EP | 0722065 | 7/1996 |
| EP | 0728989 | 8/1996 |

(Continued)

OTHER PUBLICATIONS 08251160.1 extended European search report dated Jun. 7, 2010 (9 pages).

*Primary Examiner* — Len Tran
*Assistant Examiner* — Chee-Chong Lee
(74) *Attorney, Agent, or Firm* — McDermott Will & Emery LLP

(57) ABSTRACT

A combustor for a gas turbine engine is disclosed which is able to operate with high combustion efficiency, and low nitrous oxide emissions during gas turbine operations. The combustor consists of a can-type configuration which combusts fuel premixed with air and delivers the hot gases to a turbine. Fuel is premixed with air through a swirler and is delivered to the combustor with a high degree of swirl motion about a central axis. This swirling mixture of reactants is conveyed downstream through a flow path that expands; the mixture reacts, and establishes an upstream central recirculation flow along the central axis. A cooling assembly is located on the swirler co-linear with the central axis in which cooler air is conveyed into the prechamber between the recirculation flow and the swirler surface.

7 Claims, 12 Drawing Sheets

(56) References Cited

U.S. PATENT DOCUMENTS

| | | | | | |
|---|---|---|---|---|---|
| 3,788,067 | A | | 1/1974 | Carlisle et al. | |
| 3,808,803 | A | | 5/1974 | Salvi | |
| 3,811,278 | A | | 5/1974 | Taylor et al. | |
| 3,866,413 | A | * | 2/1975 | Sturgess | 60/742 |
| 3,972,182 | A | | 8/1976 | Salvi | |
| 3,980,233 | A | | 9/1976 | Simmons et al. | |
| 4,373,325 | A | | 2/1983 | Shekleton | |
| 4,898,001 | A | * | 2/1990 | Kuroda et al. | 60/733 |
| 5,251,447 | A | | 10/1993 | Joshi et al. | |
| 5,351,477 | A | * | 10/1994 | Joshi et al. | 60/39.463 |
| 5,431,019 | A | | 7/1995 | Myers et al. | |
| 5,444,982 | A | * | 8/1995 | Heberling et al. | 60/737 |
| 5,450,724 | A | | 9/1995 | Kesseli et al. | |
| 5,511,375 | A | | 4/1996 | Joshi et al. | |
| 5,590,529 | A | | 1/1997 | Joshi et al. | |
| 5,761,906 | A | * | 6/1998 | Norster | 60/737 |
| 5,816,049 | A | | 10/1998 | Joshi | |
| 6,141,967 | A | | 11/2000 | Angel et al. | |
| 6,279,323 | B1 | | 8/2001 | Monty et al. | |
| 6,951,108 | B2 | * | 10/2005 | Burrus et al. | 60/746 |
| 7,878,000 | B2 | | 2/2011 | Mancini et al. | |
| 2009/0165435 | A1 | | 7/2009 | Koranek | |

FOREIGN PATENT DOCUMENTS

| | | |
|---|---|---|
| EP | 1672282 | 6/2006 |
| GB | 2336663 | 10/1999 |
| WO | WO 01/55646 | 8/2001 |

* cited by examiner

AIR-COOLED SWIRLERHEAD

CROSS-REFERENCE TO RELATED APPLICATIONS

This application is a divisional of Ser. No. 12/034,064, filed Feb. 20,2008, the contents of which are hereby incorporated herein by reference.

FIELD OF THE INVENTION

Background

Typical combustors are arranged to create a toroidal flow reversal that entrains and recirculates a portion of hot combustion products upstream towards the swirler, which serves as a continuous ignition source for an incoming unburned fuel/air mixture. This process helps to maintain proper combustion stability. However, since the hot reversal flow impinges on the swirler surface, it can create a high temperature spot at the center of the swirler and generate an uneven temperature distribution across the swirler which can lead to thermal stress.

SUMMARY

In one embodiment, the invention provides a combustor for combusting a mixture of fuel and air. The combustor includes a swirler for receiving a flow of air and a flow of fuel, the fuel and air being mixed together under the influence of the swirler, the swirler imparting a swirling flow to the fuel/air mixture. The swirler also has a central channel therethrough. A prechamber is in fluid communication with the swirler for receiving the swirling fuel/air mixture, the prechamber being a cylindrical member oriented along a central axis, the prechamber imparting an axial flow to the swirling fuel/air mixture in a downstream direction along the central axis, thereby creating a vortex flow of the fuel/air mixture having a low pressure region along the central axis. A combustion chamber is in fluid communication with and downstream of the prechamber, the combustion chamber having a greater flow area than the flow area of the prechamber, thereby permitting the vortex to expand radially and create a recirculation zone in which combustion products from combustion of the fuel/air within the combustion chamber are drawn upstream along the central axis back into the prechamber. The combustor also includes a cooling assembly received in the channel, the cooling assembly defining an axis that is co-linear with the central axis of the prechamber. The cooling assembly is in fluid communication with a source of air that is cooler than the recirculation flow and directs the cooler air in a downstream direction into the prechamber thereby creating a cooling flow.

In another embodiment, the invention provides a swirler for use with a combustor for combusting a mixture of fuel and air. The swirler includes a body having an outer side and an inner side and a plurality of flow guides on the inner side of the swirler body. The flow guides define flow paths between adjacent flow guides for guiding air in a swirling motion about a centerline of the swirler body. A first annular chamber is formed within the swirler body and is in fluid communication with guide tubes located adjacent to the entrances of the flow paths. A second annular chamber is formed within the swirler body and is in fluid communication with apertures located adjacent exits of the flow paths. A channel at the centerline of the body extends from the outer side to the inner side. A cooling assembly is received in the channel and is approximately flush with the body at the inner side.

In another embodiment, the invention provides a method of combusting fuel and air in a gas turbine engine. Fuel and air is premixed to a relatively uniform mixture adjacent a swirler surface at a front portion of a combustor. The fuel/air mixture is injected into a prechamber cylinder in a swirling motion about a centerline of the prechamber, thereby creating a vortex flow having a swirling and axial motion and having a low pressure region at the centerline. The vortex flow is conveyed axially in a downstream direction into a combustion cylinder having greater flow area than a flow area of the prechamber. The vortex flow is expanded into the combustion cylinder, wherein chemical reaction of the fuel and air occurs to form hot products of combustion. As a result of said expansion, a recirculation flow is formed at the centerline wherein the hot products are drawn upstream into the prechamber. Air is conveyed through the swirler at the centerline in a downstream direction into the prechamber, said conveyed air being cooler than the recirculation flow.

Other aspects of the invention will become apparent by consideration of the detailed description and accompanying drawings.

DETAILED DESCRIPTION

Figure 1:
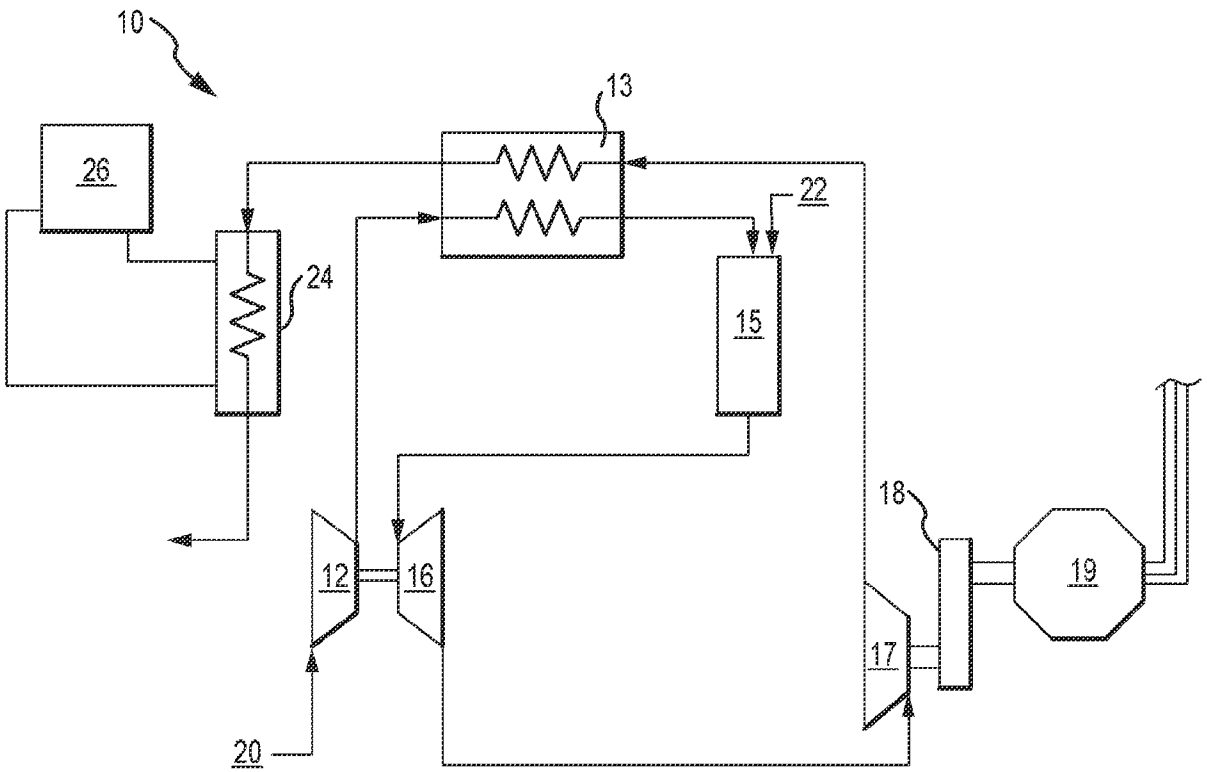
FIG. 1 is a schematic illustration of a recuperated, two-spool gas turbine engine including a combustor for use with an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The invention described herein can be used for burning various hydrocarbon fuels in a gas turbine. The combustion process comprises a method to burn lean premixed and lean pre-vaporized premixed fuel/air (F/A) mixtures. This enables lower gas turbine exhaust emissions (nitrogen oxides (NOx), carbon monoxide (CO), volatile organic compounds (VOC's)) at a wide range of operating engine conditions.

Referring now to the drawings, like numerals are used throughout to refer to like elements within a gas turbine and combustor.

FIG. 1 schematically illustrates a recuperated gas turbine engine 10 having a two spool configuration used for generating electricity. The engine 10 includes a compressor 12, a recuperator 13, a combustion chamber 15, a gasifier turbine 16, a power turbine 17, a gearbox 18, and an electric generator 19. The engine 10 communicates with an air source 20 upstream of compressor 12. The air is compressed and routed into recuperator 13. In recuperator 13, the compressed air is preheated by exhaust gases from the power turbine 17 and routed into the combustion chamber 15. Fuel 22 is then added to the combustion chamber 15 and the mixture is combusted (as described in greater detail below).

The products of combustion from the combustion chamber 15 are routed into gasifier turbine 16. The F/A ratio is regulated (i.e. the flow of fuel is regulated) to produce either a preset turbine inlet temperature or preset electrical power output from generator 19. Turbine inlet temperature entering gasifier turbine 16 can range within practical limits between 1500° F. and 2000° F. The hot gases are routed sequentially first through the gasifier turbine 16 and then through the power turbine 17. Work is extracted from each turbine to respectively transfer power to the compressor 12 and the generator 19, with shaft power transferred through gearbox 18. The hot exhaust gases from the power turbine 17 are then conveyed through the recuperator 13, where heat is transferred by means of thermal convection and conduction to the air entering the combustion chamber 15. An optional heat capturing device 24 can be used to further capture the exhaust heat for productive commercial uses. Heat capturing device 24 can be used to supply hot water, steam, or other heated fluid to device 26 which uses said heat for a variety of purposes.

Figure 2:
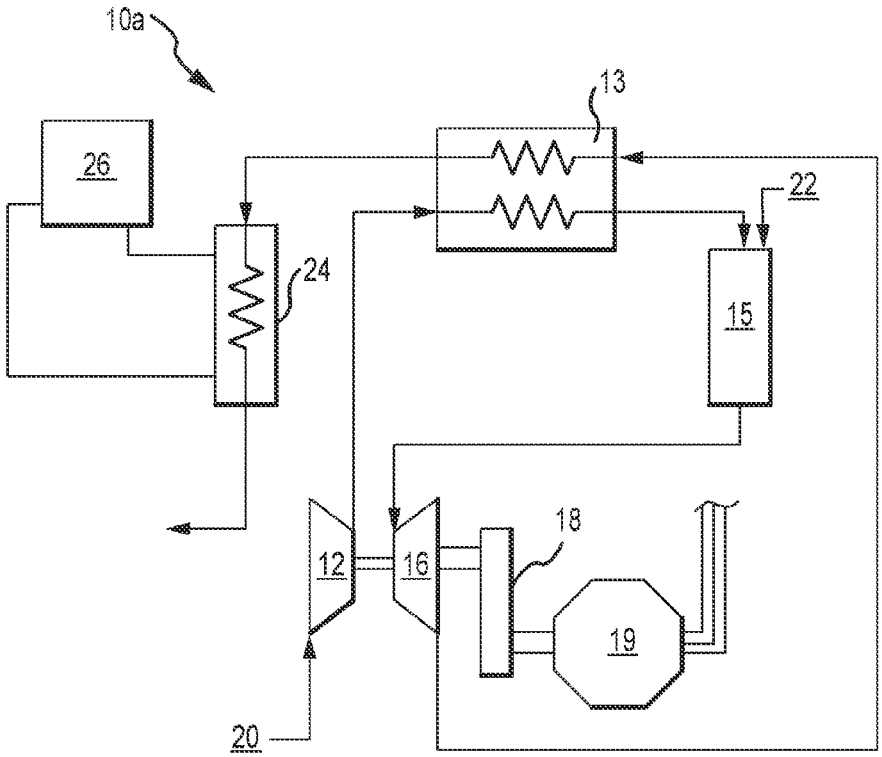
FIG. 2 is a schematic illustration of a recuperated, single-spool gas turbine engine including a combustor for use with an embodiment of the invention.

FIG. 2 schematically illustrates a recuperated gas turbine engine 10*a* used for generating electricity. Gas turbine 10*a* is similar to FIG. 1, with the exception that only a single turbine is used. The engine 10*a* includes a compressor 12, a recuperator 13, a combustion chamber 15, a turbine 16, a gearbox 18, and an electric generator 19. The engine 10*a* communicates with an air source 20 upstream of compressor 12. The air is compressed and routed into recuperator 13. In recuperator 13, the compressed air is preheated by exhaust gases from turbine 16 and routed into the combustion chamber 15. Fuel 22 is then added to the combustion chamber 15 and the mixture is combusted (as described in greater detail below).

The products of combustion from the combustion chamber 15 are routed into turbine 16. The F/A ratio is regulated (i.e. the flow of fuel is regulated) to produce either a preset turbine inlet temperature to turbine 16 or preset electrical power output from generator 19. Turbine inlet temperature can range within practical limits between 1500° F. and 2000° F. Work is extracted from the turbine to transfer power to both compressor 12 and the generator 19, with shaft power transferred through gearbox 18. The hot exhaust gases from turbine 16 are then conveyed through the recuperator 13, where heat is transferred by means of thermal convection and conduction to the air entering the combustion chamber 15. An optional heat capturing device 24 can be used to further capture the exhaust heat for productive commercial uses. Heat capturing device 24 can be used to supply hot water, steam, or other heated fluid to device 26 which uses the heat for a variety of purposes.

Figure 3:
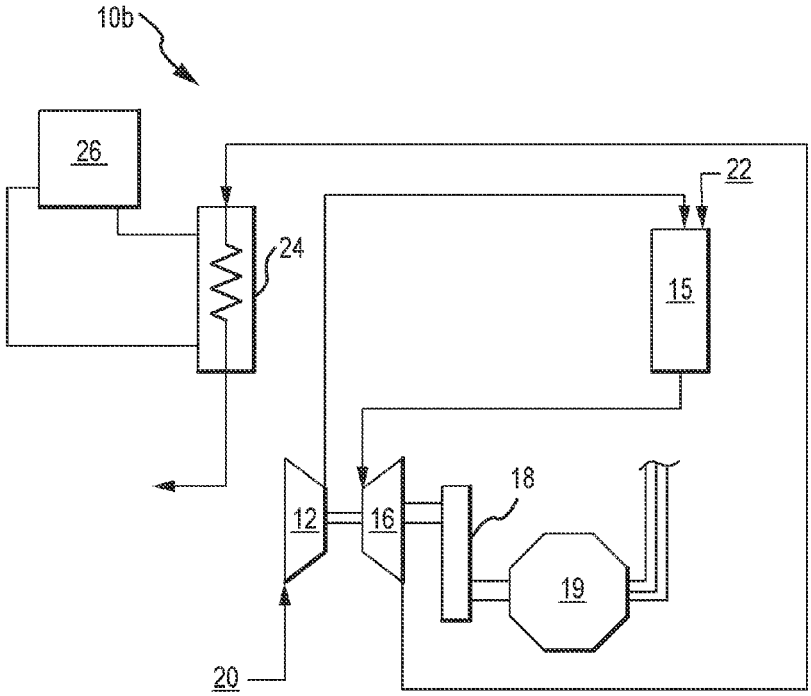
FIG. 3 is a schematic illustration of a simple-cycle, single-spool gas turbine engine including a combustor for use with an embodiment of the invention.

FIG. 3 schematically illustrates a simple-cycle gas turbine engine 10*b* used for generating electricity. Gas turbine 10*b* is similar to FIG. 2, with the exception that no recuperator exists. The engine 10*b* includes a compressor 12, a combustion chamber 15, a turbine 16, a gearbox 18, and an electric generator 19. The engine 10*b* communicates with an air source 20 upstream of compressor 12. The air is compressed and routed into combustion chamber 15. Fuel 22 is then added to the combustion chamber 15 and the mixture is combusted (as described in greater detail below).

The products of combustion from the combustion chamber 15 are routed into turbine 16. The F/A ratio is regulated (i.e. the flow of fuel is regulated) to produce either a preset turbine inlet temperature or preset electrical power output from generator 19. Turbine inlet temperature to turbine 16 can range within practical limits between 1500° F. and 2000° F. Work is extracted from the turbine 16 to transfer power to both compressor 12 and the generator 19, with shaft power transferred through gearbox 18. The hot exhaust gases from turbine 16 are then conveyed to either the exhaust, or an optional heat capturing device 24 can be used to further capture the exhaust heat for productive commercial uses. The heat capturing device 24 can be used to supply hot water, steam, or other heated fluid to device 26 which uses said heat for a variety of purposes.

FIGS. 1-3 illustrate gas turbine component arrangements that can be used with various embodiments of the invention. A variety of other engine configurations (multiple spools, multiple compressor and turbine stages) could also be used in conjunction with the invention. For example, instead of using gearbox 18 and generator 19, one could use a high-speed generator to generate a high-frequency alternating current (AC) power signal, and then use a frequency inverter to convert this to a direct current signal (DC). This DC power could then be converted back to an AC power supplied at a variety of typical frequencies (i.e. 60 Hz or 50 Hz). The invention is not limited to the gas turbine configurations of FIGS. 1-3, but includes other component combinations that rely on the Brayton cycle to produce electric power and hot exhaust gases useful for hot water generation, steam generation, absorption chillers, or other heat-driven devices.

Figure 4:
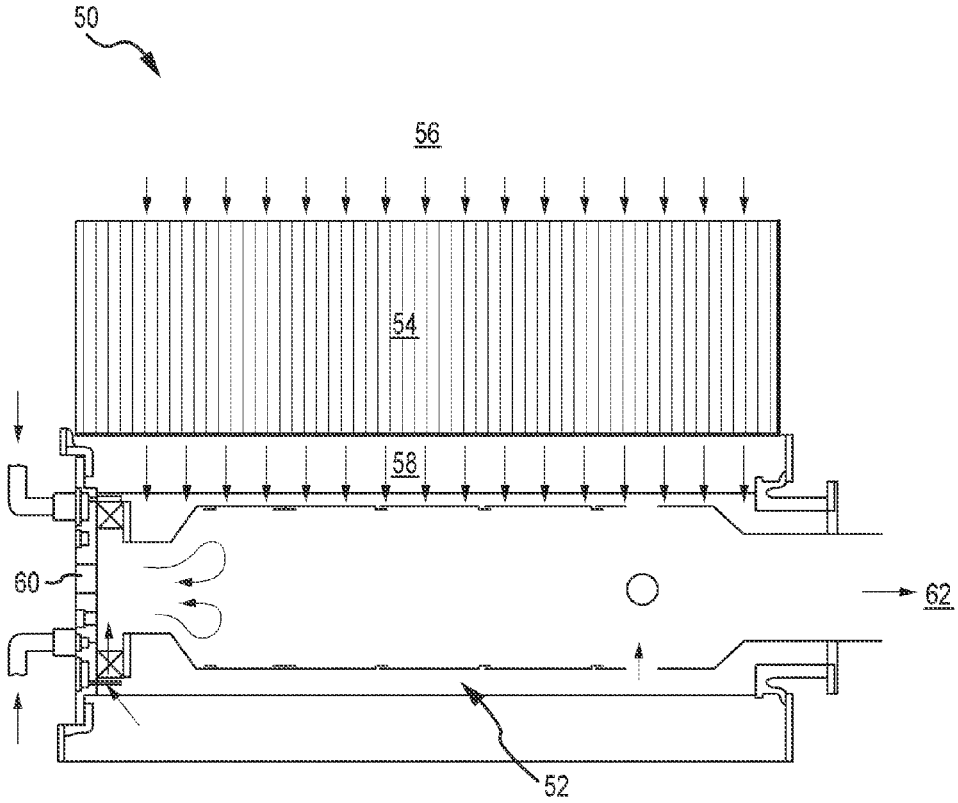
FIG. 4 is a schematic illustration of a can- or silo-type combustor inside a recuperator for use with an embodiment of the present invention.

FIG. 4 illustrates a recuperator 50. Recuperator 50 can be similar to the recuperator disclosed in U.S. Pat. No. 5,983,992, issued Nov. 16, 1999, the entire contents of which are incorporated herein by reference. The recuperator 50 includes a plurality of stacked cells 54 that are open at each end to an inlet manifold 56 and an outlet manifold 58 and which route the flow of compressed air from the inlet manifold 56 to the outlet manifold 58. Between the cells 54 are exhaust gas flow paths that guide the flow of hot exhaust gas between the cells 54. There are fins in the cells 54 and in the exhaust gas flow paths to facilitate the transfer of heat from the hot exhaust gas to the cooler compressed air mixture.

With continued reference to FIG. 4, the outlet manifold 58 contains a silo or tubular combustor 52 and a swirler 60. Air entering outlet manifold 58 flows around the outside of the combustor 52. The air then flows into the combustor 52 through a variety of orifices and slots in combustor 52 and swirler 60, and exits the combustor 52 with a flow as indicated by arrow 62. The overall flow 62 of the air in the combustor 52 can be considered to define an orientation of the combustor 52 with the flow 62 being oriented in a downstream direction, i.e., from left to right, such that the swirler 60 is upstream of the combustor 52.

Figure 5:
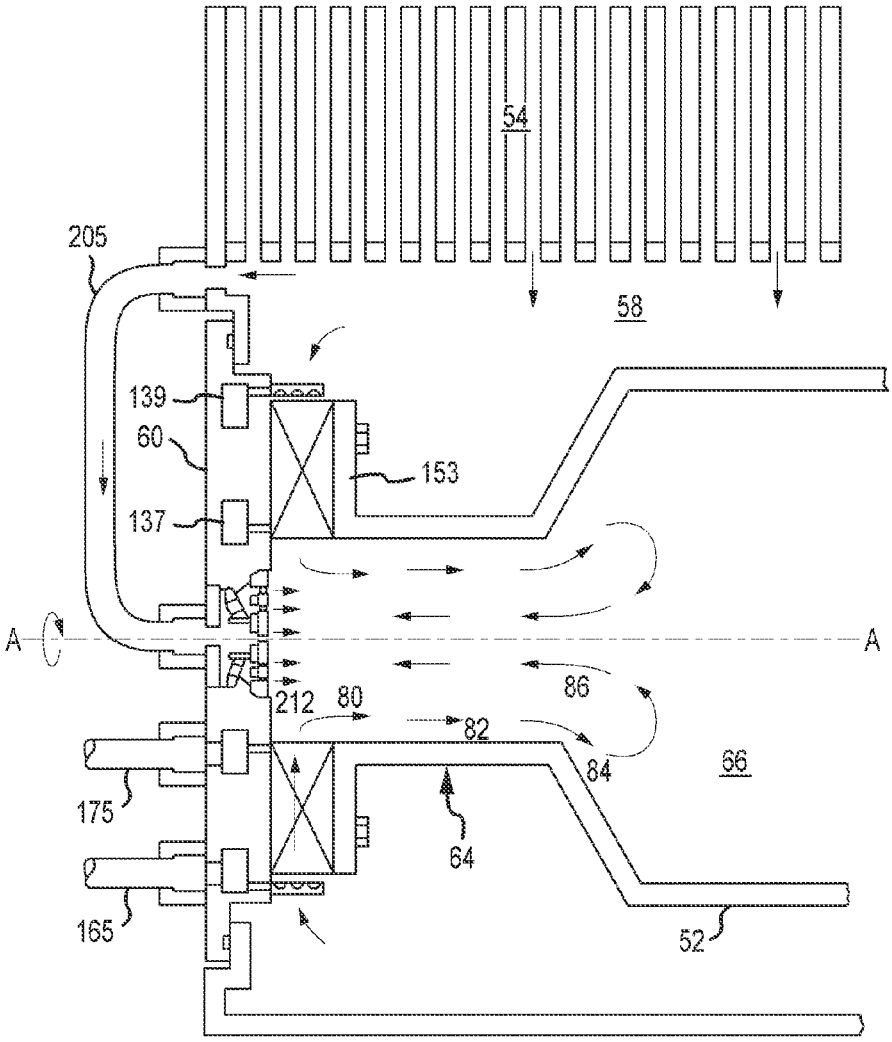
FIG. 5 is a schematic illustration of a swirler, prechamber and combustion chamber according to an embodiment of the invention.

FIG. 5 shows a cross-sectional view of the swirler 60 and a portion of the combustor 52. The combustor 52 includes a prechamber 64 and a combustion chamber 66 that is downstream of the prechamber 64. As illustrated, the prechamber 64 has a smaller diameter than the combustion chamber 66. Compressed air from the outlet manifold 58 is conveyed sequentially downstream through the swirler 60 to the prechamber 64, and then to combustion chamber 66, inside combustor 52. Air flows into the prechamber 64 through the swirler 60. Air pressure in the outlet manifold 58 is higher than the air pressure inside the combustion chamber 66, and this pressure difference provides the energy potential to convey air through the swirler 60.

Figure 6A:
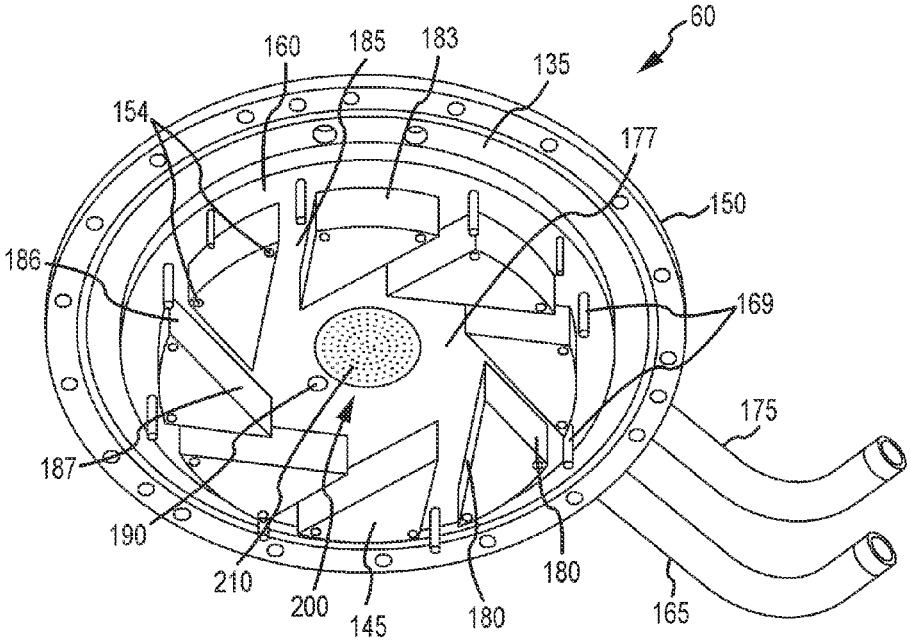
FIG. 6A is front perspective view of a radial swirler according to an embodiment of the invention.
Figure 6B:
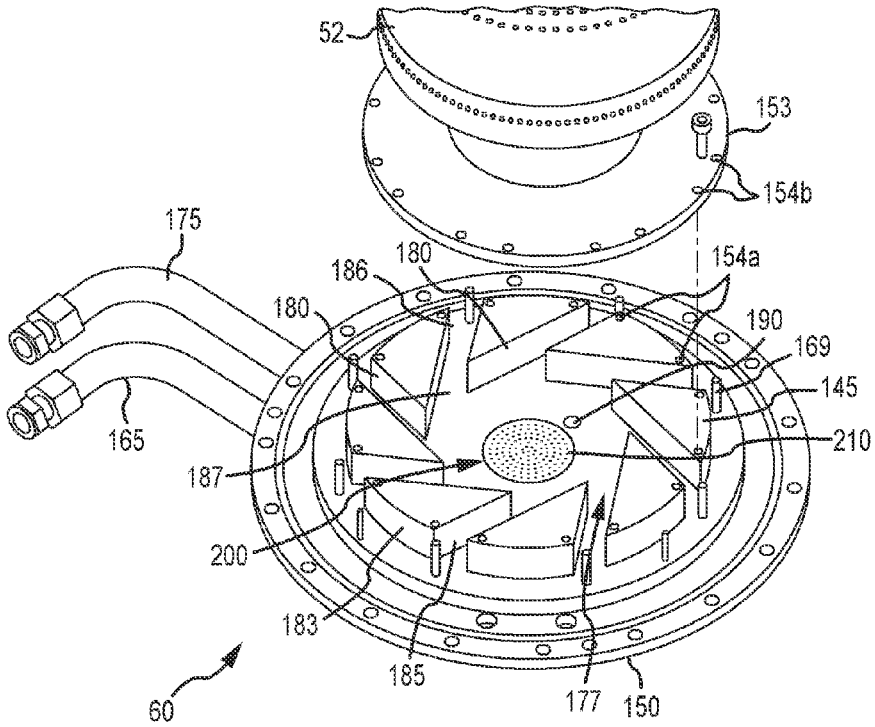
FIG. 6B is an exploded view of the swirler of FIG. 6A, a combustor flange and a combustor.
Figure 7:
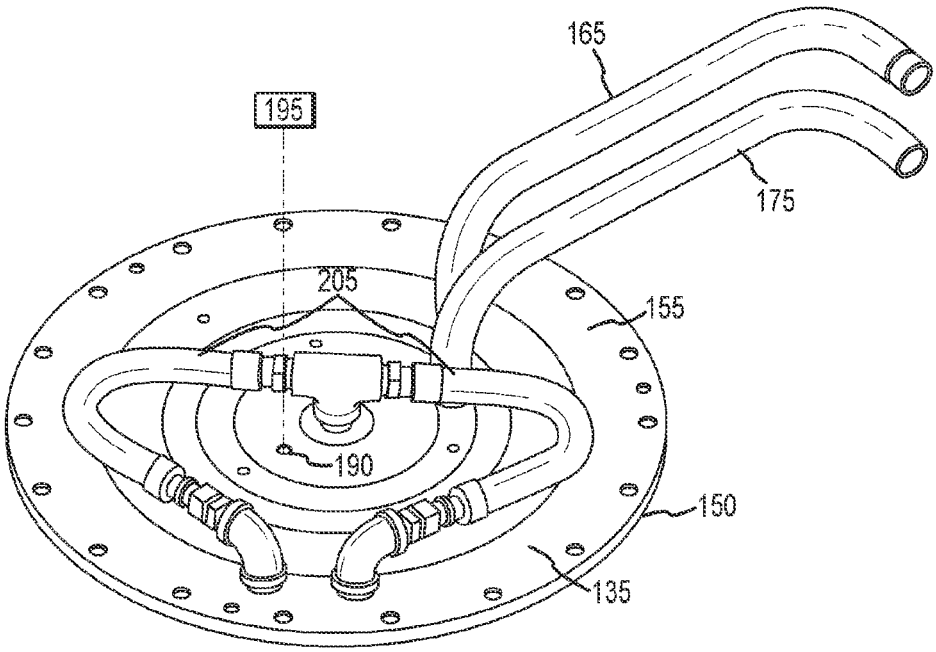
FIG. 7 is rear perspective view of the radial swirler of FIG. 6A.
Figure 8:
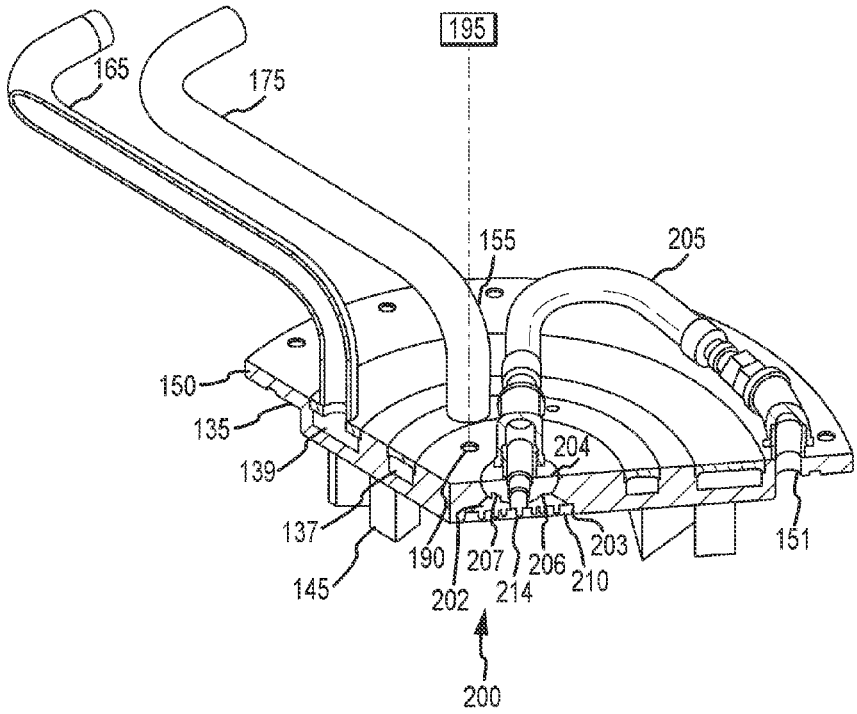
FIG. 8 is a cut-away view of the swirler of FIG. 6A.

FIGS. 6-8 show the swirler 60 according to an embodiment of the invention. The swirler 60 is disc-shaped and includes a body 135 and a cooling assembly 200. The body 135 defines an inner annular chamber 137, an outer annular chamber 139 and a plurality of flow guides 145. The body 135 further includes a circumferential flange 150 that facilitates the attachment of the swirler 60 to the recuperator 50. The flange 150 separates the swirler 60 into an outer portion or side 155 and an inner portion or side 160 that faces the prechamber 64. The inner side 160 faces the combustion chamber 66, while the outer portion 155 faces away. As illustrated herein, the swirler 60 is a separate component that attaches to the combustor 52. In some embodiments, the swirler 60 forms a sealing engagement at the flange 150 with the recuperator 50. However, other constructions employ a swirler head that is formed as part of the combustor 52. In still other constructions, the swirler 60 is a separate component positioned away from the remainder of the combustor 52.

The outer chamber 139 is an annular chamber within the body 135 of the swirler 60. A fuel inlet 165 can be coupled to the outer side 155 of the body 135 in fluid communication with the outer chamber 139 to deliver fuel into the outer chamber 139. A plurality of bores between the outer chamber 139 and the inner side 160 of the swirler 60 permit fuel in the outer chamber 139 to flow through the swirler 60 into the prechamber 64. Guide tubes 169 extending from the inner side 160 of the swirler 60 adjacent to the bores guide the flow of fuel into the prechamber 64.

The inner chamber 137 is disposed radially inwardly of the outer chamber 139. A pilot fuel inlet 175 can be coupled to the outer side 155 of the body 135 in fluid communication with the inner chamber 137 to deliver pilot fuel into the inner chamber 137. A plurality of bores 177 between the inner chamber 137 and the inner side 160 of the swirler 60 permit pilot fuel in the inner chamber 137 to flow through the swirler 60 into the prechamber 64. The pilot fuel inlet 175 provides a flow of fuel through the swirler 60 that may be used to maintain the flame stability within the combustor 52 at low power settings or to initiate combustion within the combustor 52 during engine start.

Also visible on the outer side 155 of the swirler 60 is a hole 190 in the swirler 60 for receiving an ignition device 195. The ignition device 195 provides a flame, spark, hot surface or other ignition source to initiate combustion during engine start-up or at any other time when a flame is desired but not present.

The flow guides 145 are generally raised triangular blocks on the inner side 160 of the body 135. Each flow guide 145 has two planar surfaces 180 and an arcuate outer surface 183. The planar surfaces 180 of each flow guide 145 are arranged such that they are substantially parallel to the planar surfaces 180 of the adjacent flow guides 145. Using this arrangement, a plurality of flow paths 185 are defined between adjacent flow guides 145 extending inwardly. The flow paths 185 are oriented to inject the premixed fuel and air into the prechamber 64 with a high degree of swirl about a centerline or central axis A (see FIG. 5) of the cylindrical prechamber 64. Many different arrangements are possible to direct fuel and air into the prechamber 64. As such, the invention should not be limited to the aforementioned example.

The flow guides 145 are disposed radially between the inner chamber 137 and the outer chamber 139. Thus, the guide tubes 169 communicating with the outer chamber 139 are located at an outer end or entrance 186 of the flow paths 185 and the bores 177 communicating with the inner chamber 137 are located at an inner end or exit 187 of the flow paths 185 (see FIG. 6A). Referring now to FIG. 6B, an annular combustor flange 153 is mounted to flow guides 145 with fasteners (not shown) at aligned openings 154*a*, 154*b*. The combustor flange 153 partially encloses the flow paths 185 to facilitate the flow of air and fuel from the entrances 186 to the exits 187. The combustor flange 153 can also be secured to the combustor 52 to facilitate securing the swirler 60 to the combustor 52.

By injecting the fuel at the entrance 186 to the flow path 185, the fuel and air have adequate time to thoroughly mix prior to exiting the flow path 185 at the exit 187. This uniform mixture of F/A reduces the likelihood of fuel-rich burning in combustion chamber 66, which could lead to high levels of NOx. In other embodiments, fuel could be injected at a plurality of other locations also, so as to ensure the F/A mixture leaving the flow paths 185 uniformly mixed.

The hole 190 for the ignition device 195 is located between the centerline A of the prechamber 64 and an inside "diameter" defined by the flow path exits 187. The ignition device 195 can ignite the premixed F/A exiting the flow paths 185 and can ignite the pilot fuel exiting the holes 177, but is not subjected to and/or is less subjected to the high temperatures of an inner recirculation zone 86 (see discussion below with regard to FIG. 5).

As shown in FIG. 5, premixed F/A is injected into the prechamber 64 with a swirling flow path or directionality under the influence of the action of the swirler 60, as indicated by arrow 80. Other structures may be provided to impart a swirl to the F/A mixture and introduce it to the prechamber 64. The swirling F/A mixture 80 is conveyed in a downstream direction through the prechamber 64 and exits the prechamber 64 into the combustion chamber 66. This axial motion is combined with a swirling motion about the centerline axis A of the combustion chamber 66, producing a vortex, indicated by arrow 82. This vortex 82 creates a pressure difference between the center of the vortex 82, located at the centerline A, and the inner perimeter of the prechamber 64. The centerline of the vortex 82 is at a lower pressure than the outside edge of the vortex 82, similar to the low pressure experienced at the center of a hurricane.

The flow area in the combustion chamber 66 has a larger cross-sectional area than the flow area in the prechamber 64 (i.e., the combustion chamber 66 has a greater inner diameter than the prechamber 64). When the axially processing vortex 82 enters the combustion chamber 66, the increase in flow area causes the vortex 82 to expand radially and slow its axial and rotational or swirling movement, as indicated by arrow 84. The expanded vortex 84 has a reduced pressure difference between the outside edge of the vortex 84 and the center. Thus, the centerline A of the prechamber 64 at the vortex 82 is at a lower pressure than the centerline of the combustion chamber 66 at the vortex 84. An inner recirculation flow, as indicated by arrow 86, is established which pulls a portion of the gases from the combustion chamber 66 back into the prechamber 64 in an upstream direction, i.e., from right to left. This process is referred to herein as a "vortex breakdown" structure and stabilizes the flame in the combustion chamber 66.

The F/A mixture conveyed from the prechamber 64 to the combustion chamber 66 chemically reacts in a combustion flame. The products of combustion are hotter than the reactants introduced into the prechamber 64 (i.e., the premixed F/A at flow 80). The inner recirculation flow 86 therefore is composed of hot products of combustion. The inner recirculation flow 86 is directionally opposed to the unburned F/A mixture of vortex 82, and an inner shear layer is established between the two. Hot gas products and combustion radicals in the recirculation flow 86, which are unstable electrically-charged molecules like hydroxide anion (OH−), oxygen anion (O−), and methylidyne cation (CH+) are exchanged with the unburned F/A of vortex flow 82. Recirculation flow 86 serves as a continued ignition source for vortex flow 82. The chemical radicals also enhance the reactivity of the unburned mixture of vortex flow 82, enabling the F/A mixture of vortex flow 82 to extinguish combustion at a lower F/A ratio than if vortex flow 82 did not have the radicals from recirculation flow 86.

Figure 9:
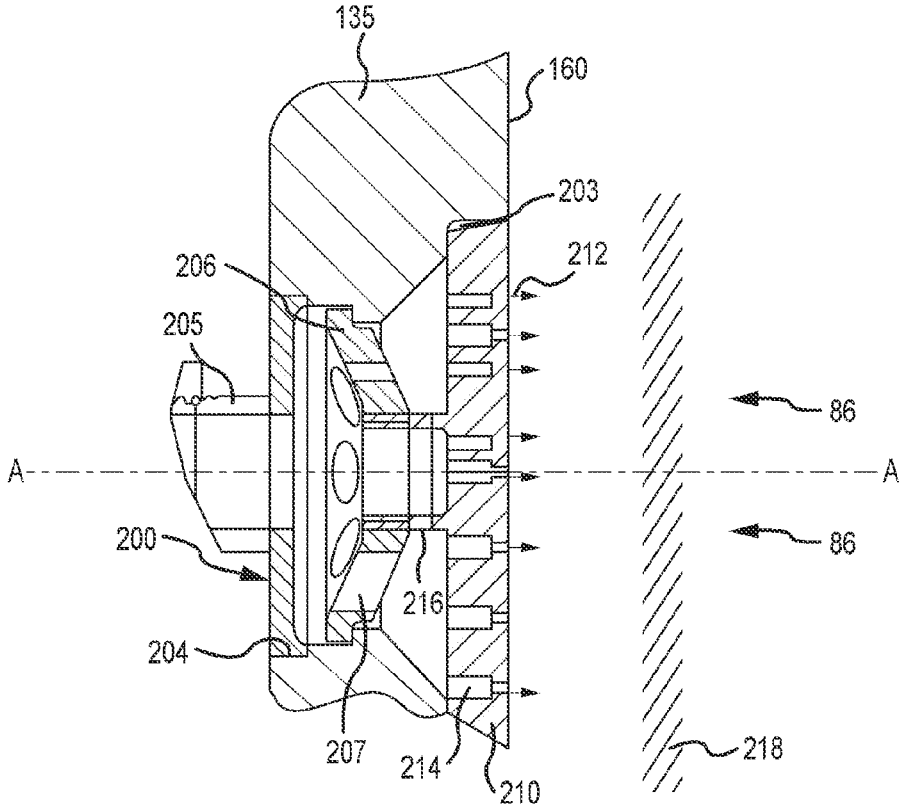
FIG. 9 is a sectional view of the cooling assembly of FIG. 8.
Figure 10:
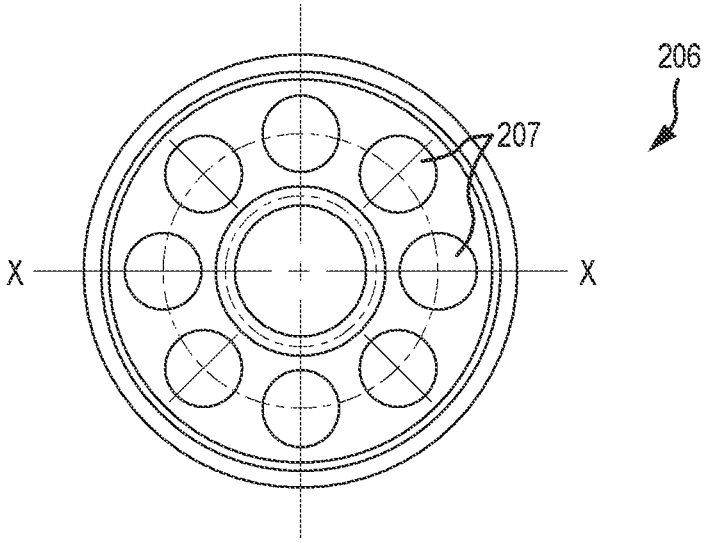
FIG. 10 is a front view of the distribution ring of FIG. 9.
Figure 11:
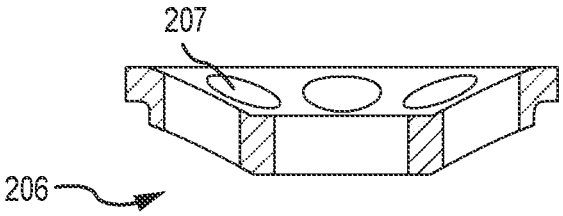
FIG. 11 is a sectional view of the distribution ring of FIG. 10 taken along line X-X.
Figure 12:
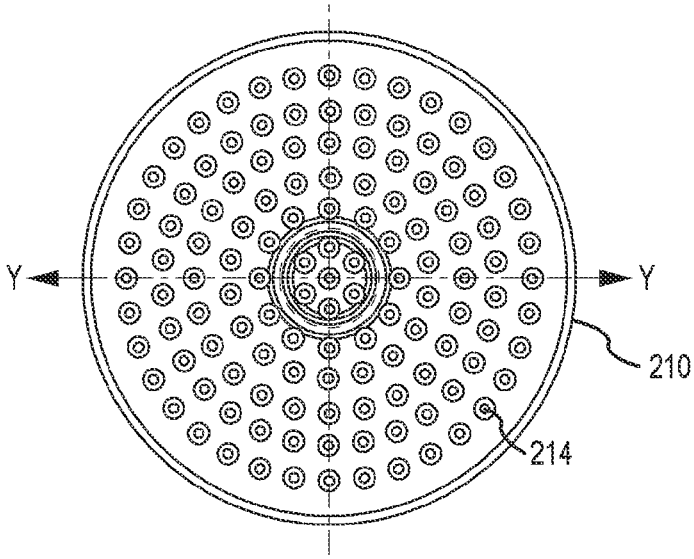
FIG. 12 is a front view of the heat shield of FIG. 9.
Figure 13:
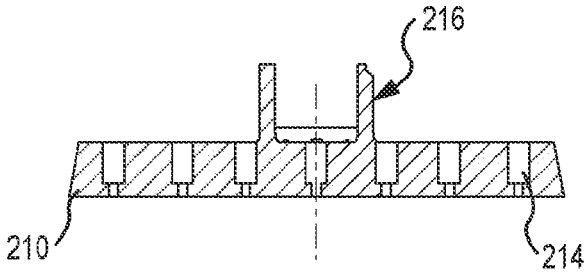
FIG. 13 is a sectional view of the heat shield of FIG. 12 taken along line Y-Y.

FIGS. 8 and 9 illustrate the cooling assembly 200. Air, including recuperated air, can be injected through the cooling assembly 200 into the prechamber 64. The cooling assembly 200 is provided to reduce any temperature differential across the inner surface 160 of the swirler 60 that may be generated by the hot recirculation flow 86 at the centerline A.

The cooling assembly 200 resides in a channel 202 extending through the swirler 60 at the centerline A. In general, the channel 202 and the cooling assembly define a central axis that is co-linear with the central axis A of the prechamber 64. The channel 202 has sloped sides, so that a channel opening 203 on the inner side 160 is larger than a channel opening 204 on the outer side 155 (see FIGS. 8-9). The outer channel opening 204 can be coupled to an air inlet 205 so that the channel 202 is in fluid communication with a source of cooling air. In the illustrated embodiment, the air inlet 205 receives air from the recuperator 50. Specifically, the air inlet 205 is coupled to an opening 151 in the flange 150 that is in fluid communication with the recuperator 52 (see FIG. 8). However, any source of air that is cooler than the recirculation flow 86 will suffice.

As shown in FIGS. 8-11, the cooling assembly 200 includes a distributor ring 206 and a perforated shield 210. The distributor ring 206 is located within the channel 202 downstream of the air inlet 205. The ring 206 includes a plurality of apertures 207 for receiving air therethrough from the air inlet 205. In some embodiments, the apertures 207 are angled outwardly to direct air flowing therethrough uniformly onto the shield 210.

Downstream of the distributor ring 206, the shield 210 covers the inner opening 203 of the channel 202 (see FIGS. 8-9). The shield 210 includes a plurality of apertures 214 for permitting air flow through the shield 210. In the illustrated embodiment, the apertures 214 are in the form of nozzles. In some embodiments, the shield 210 is approximately flush with the inner side 160 of the swirler 60.

The shield 210 includes a sleeve 216 for threadedly coupling the shield 210 to the distributor ring 206. A portion of the swirler body 135 adjacent to the channel 202 is clamped between the shield 210 and the distributor ring 206 to secure the cooling assembly 200 to the swirler 60. This arrangement permits some expansion and contraction of the shield 210 relative to the swirler 60. In other embodiments (not shown), the distributor ring 206 is snap-fit, bolted, adhesively bonded or otherwise coupled to the shield 210. In other embodiments (not shown), the shield 210 and/or the distributor ring 206 are coupled to the swirler 60 through a threaded coupling or a snap-fit coupling at the channel 202, can be bolted to the swirler 60, and can be adhesively coupled to the swirler 60. In still other embodiments, all or a portion of the cooling assembly 200 is integrally formed with the swirler 60.

Air from the cooling air inlet 205 flows through the apertures 207 in the distributor ring 206 into the channel 202. Heat is conducted from the swirler 60 to the cooling assembly 200 while still within the channel 202, then transferred by convection to the air flowing through the channel 202. The air flowing through the channel 202 flows through the apertures 214 in the shield 210 and into the prechamber, generating a cooling flow, indicated at arrow 212. The heat transferred from the swirler to the cooling assembly 200 is removed from the swirler 60 as the cooling flow 212 exits the channel 202 and flows into the prechamber 64. This can facilitate reducing the temperature of the swirler 60 adjacent to the cooling assembly 200 and of the cooling assembly 200 itself.

Referring to FIG. 9, the cooling flow 212 flows opposite to and meets with the recirculation flow 86 to generate a stagnation plane, indicated at 218, between the swirler inner side 160 and the recirculation flow 86 (see also FIG. 5). The cooling flow 212 as well as the stagnation plane 218 form an air layer separating the swirler inner side 160 from the hot recirculation flow 86. This air layer provides a thermal barrier to heat transfer from the recirculation flow 86 to the swirler 60. Any heat transfer from the recirculation flow 86 to the swirler 60 passes through the air layer via conduction rather than convection.

The cooling assembly 200 can be formed of a different material than the swirler 60. For example, the cooling assembly 200 can be formed of one or more materials having a different resistance to thermal transfer and/or coefficient of thermal expansion than the material of the swirler 60. In other embodiments, all or a portion of the cooling assembly 200 is formed of the same material(s) as the swirler 60.

The cooling assembly 200 inhibits the forming of a "hot spot" on the swirler inner side 160 at the centerline A due to impingement of the hot recirculation zone 86. This provides for a more radially uniform swirler temperature during use. Radial temperature uniformity can reduce nonuniform thermal stresses on the swirler 60 (such as, for example, increased thermal expansion at the centerline A in relation to thermal expansion closer to the flange 150), thereby increasing the life of the swirler 60. In addition, the cooling assembly 200 can be formed of a material that has a greater resistance to thermal expansion than the remainder of the swirler 60, regardless of the operation of the cooling flow 212. Furthermore, the cooling assembly 200 can be formed separately from the swirler 60, so that some or all of the thermal stresses on the cooling assembly 200 are not mechanically transferred to the remainder of the swirler 60. For example, the cooling assembly 200 can be allowed to undergo thermal expansion and contraction separately from the remainder of the swirler 60.

In addition to a single can combustor, can-annular combustor arrangements are commonly used, where multiple single combustor cans are oriented upstream of an annular combustor liner. Transition hardware is used to convey the combustion gases from the individual cans to the annular portion of the combustor. The annular portion of the combustor then conveys hot gases to a turbine, typically with the use of turbine nozzles or turbine vanes. The invention disclosed herein is applicable to can-annular combustors, applying to the upstream portion where fuel and air are injected and flow stabilization occurs.

Thus, the invention provides, among other things, a method and apparatus to inhibit circumferentially non-uniform thermal stresses on the swirler surface. Various features and advantages of the invention are set forth in the following claims.

What is claimed is:

1. A swirler for use with a combustor for combusting a mixture of fuel and air, the swirler comprising:

a body having an outer side and an inner side;

a plurality of flow guides on the inner side of the swirler body, the flow guides defining flow paths between adjacent flow guides for guiding air in a swirling motion about a centerline of the body;

a first annular chamber formed within the body, the first annular chamber being in fluid communication with guide tubes located at a first end of the flow paths;

a second annular chamber formed within the body, the second annular chamber being in fluid communication with apertures located at a second end of the flow paths;

a channel at the centerline of the body extending from the outer side to the inner side; and a cooling assembly received in the channel, the cooling assembly having a perforated shield at an innermost end of the cooling assembly, the perforated shield being approximately flush with the body at the inner side, the perforated shield having apertures extending parallel to the centerline and entirely through the perforated shield, at least one of the apertures being disposed at the centerline, the apertures being configured to axially inject cooling flow along the centerline into a reaction chamber such that a stagnation plane is formed between the swirler and a recirculation flow of the reaction chamber.

2. The swirler of claim 1, wherein the shield covers the channel at the inner side of the body.

3. The swirler of claim 2, further comprising a distribution ring configured to receive cooling flow from an inlet, the distribution ring having ports angled outwardly to direct the cooling flow onto the shield, wherein the perforated shield includes a sleeve for coupling to the distribution ring.

4. The swirler of claim 2, wherein the apertures are in the form of nozzles.

5. The swirler of claim 1, wherein the cooling assembly is formed of a first material and the body is formed of a second material different from the first material.

6. The swirler of claim 5, wherein the first material has a first coefficient of thermal expansion and the second material has a second coefficient of thermal expansion different from the first coefficient of thermal expansion.

7. The swirler of claim 1, wherein the channel has sloped sides expanding toward the inner side of the body.

* * * * *